United States Patent [19]

Axton et al.

[11] 4,409,644

[45] Oct. 11, 1983

[54] BATTERY SYSTEM ADAPTER FOR USING FILM POWER PACKS

[75] Inventors: Hoyt W. Axton, Tahoe City; Corey B. Bailey, Lake View Terrace, both of Calif.

[73] Assignee: Sierra Survival Company, Inc., Ada, Okla.

[21] Appl. No.: 272,987

[22] Filed: Jun. 12, 1981

[51] Int. Cl.[3] ..... F21L 7/00

[52] U.S. Cl. ..... 362/200; 200/60; 362/184; 362/186; 362/189; 362/208; 362/234; 362/253; 362/362

[58] Field of Search ..... 362/184, 186, 189, 200, 362/208, 253, 362, 234; 200/60

[56] References Cited

U.S. PATENT DOCUMENTS

| | | | |
|---|---|---|---|
| 3,798,439 | 3/1974 | Land et al. | 362/196 |
| 4,250,539 | 2/1981 | Leitzel et al. | 362/200 |
| 4,285,030 | 8/1981 | Menelly | 362/208 |
| 4,364,103 | 12/1982 | Harshbarger | 362/200 |
| 4,368,507 | 1/1983 | Reynolds | 362/200 |

*Primary Examiner*—Stephen J. Lechert, Jr.
*Attorney, Agent, or Firm*—Dunlap & Codding

[57] ABSTRACT

A battery system which is adapted to use film power packs as the source of electrical energy including a case adapted, for receiving and retainingly accommodating at least one film power pack and contact means having a portion contactable with the film power pack terminals when the film power pack is disposed in the case. In one aspect, the system includes means for receiving light emitting means and means for establishing electrical continuity between the film power terminals via the contact means and the light emitting means for causing the light emitting means to emit light.

4 Claims, 32 Drawing Figures

BATTERY SYSTEM ADAPTER FOR USING FILM POWER PACKS

BACKGROUND OF THE INVENTION

Field of the Invention

The present invention relates generally to battery systems and, more particularly, but not by way of limitation, to a battery system adapted for using film power packs as the source of electrical energy and, in one aspect, including a light emitting means for emitting light in an "on" condition.

BRIEF DESCRIPTION OF THE PREFERRED EMBODIMENTS

The present invention generally relates to a battery system which is adapted to utilize film power packs as the source of electrical energy and, in one aspect, the present invention includes means for accommodating a light emitting means which is constructed to emit light when electrically connected to the film power pack, such devices generally being referred to in the art as "flashlights".

There are commercially available cameras which are constructed to produce still pictures. Such cameras are constructed to receive a film power pack which includes several unexposed film prints and a battery element portion, all supported within a case. The battery element portion provides all or a portion of electrical power supply for operating various functions of the camera when the film power pack is inserted into the appropriate opening in the camera. The unexposed film prints are adapted to develop an exposed still picture so the user has the developed still picture available within a few seconds after exposure with the camera. One such commercially available camera is sold by Polaroid Corporation of Cambridge, Mass. and is generally referred to by the designation "Polaroid SX-70 Land Camera". This particular camera utilizes a film power pack which is designated by Polaroid Corporation as the "Polaroid SX-70 Land Film, Time-Zero Supercolor", and which includes a battery element portion designated by Polaroid Corporation as the "Polaroid Polapulse Battery".

After the camera has been utilized to expose all of the film prints, it has been the practice in the past to dispose of or throw-away the film power pack. It has been found that the battery element portion of the film power pack still has a usable battery life after the film power pack has been utilized by the camera in exposing all of the film prints in the film power pack. The present invention provides a means for utilizing the film power pack which, in the past, has been thrown away.

Figure 1:
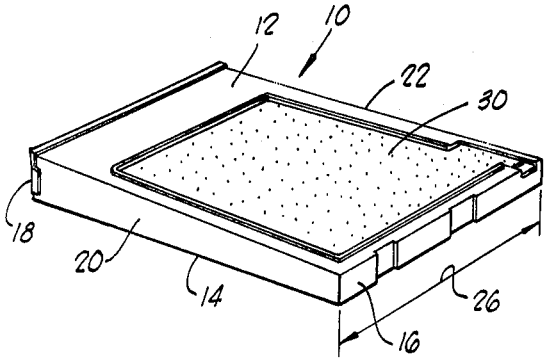
FIG. 1 is a diagrammatic view of a film power pack with the film disposed therein (the film being covered by a card cover), showing the upper surface, one side and one end of the film power pack.
Figure 2:
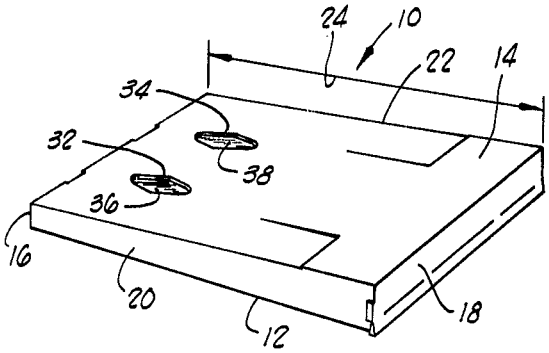
FIG. 2 is a diagrammatic view of the film power pack of FIG. 1, but showing the lower surface, the opposite side and the opposite end of the film power pack.
Figure 3:
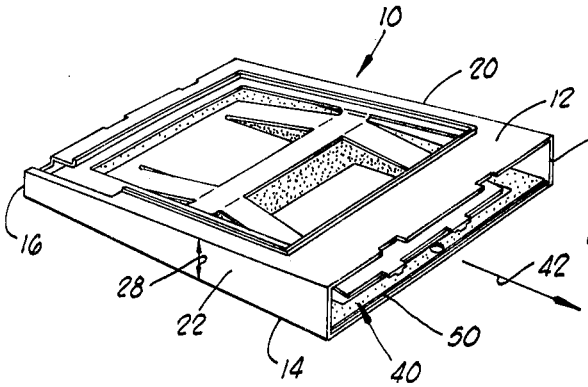
FIG. 3 is a diagrammatic view, similar to FIG. 1, but showing the film power pack with the film and card cover removed therefrom, and showing one end of the film power pack removed.
Figure 4:
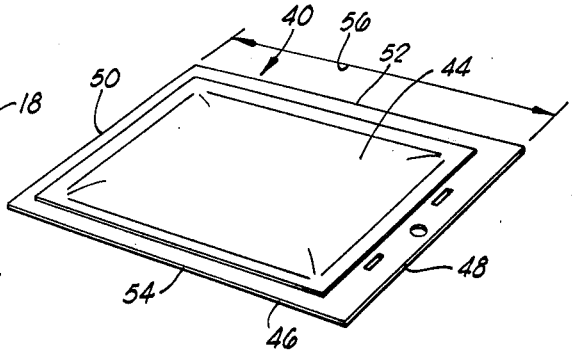
FIG. 4 is a diagrammatic view of the battery element portion of the film power pack, generally showing the upper surface, one side and one end of the battery element portion.
Figure 6:
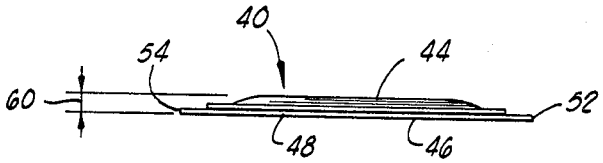
FIG. 6 is a typical end elevational view of the battery element portion.
Figure 5:
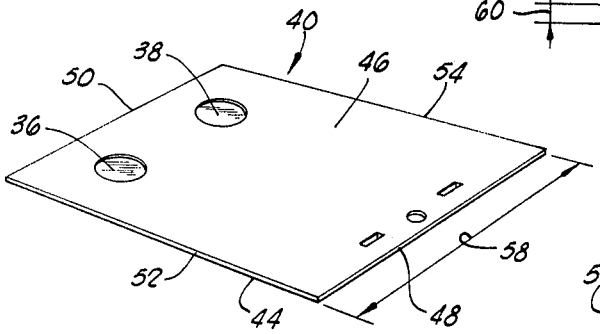
FIG. 5 is a diagrammatic view similar to FIG. 4, but showing the lower surface, the opposite side, and the opposite end of the battery element portion.
Figure 7:
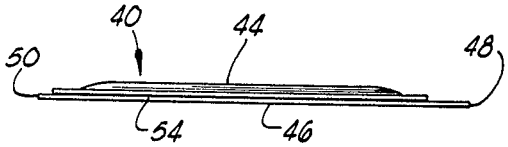
FIG. 7 is a typical side elevational view of the battery element portion.

Shown in FIGS. 1, 2 and 3 is a film power pack 10 of the type contemplated by the present invention. The film power pack 10 has an upper surface 12, a lower surface 14, a forward end 16, a rearward end 18, a first side 20 and a second side 22. The film power pack 10 also has a length 24 (FIG. 2) extending generally between the forward and rearward ends 16 and 18, a width 26 (FIG. 1) extending generally between the first and second sides 20 and 22, and a height 28 (FIG. 3) extending generally between the upper and lower surfaces 12 and 14. The upper surface 12 of the film power pack 10 is tapered downwardly generally from the rearward end 18 toward the forward end 16 so the height of the film power pack 10 at the forward end 16 is slightly less than the height of the film power pack 10 at the rearward end 18, the height 28 being generally the average height of the film power pack 10. As shown in FIGS. 1 and 2, the film power pack 10 still has the unexposed film prints retained therein, such film prints (now shown) being disposed generally under the card cover 30.

As shown in FIG. 2, a pair of openings 32 and 34 are formed through a portion of the film power pack 10. The battery element portion is positioned within the film power pack 10 and the openings 32 and 34 are positioned with respect to the battery element portion such that a pair of film power pack terminals 36 and 38 are disposed under the openings 32 and 34, respectively, and are provided as a means for electrically connecting to a battery element portion 40.

Shown in FIG. 3 is a view of the film power pack 10 of FIGS. 1 and 2 after the film prints have been used. Thus, the film prints and the card cover 30 have been removed from the film power pack 10 shown in FIG. 3. In one aspect, the present invention contemplates using the film power pack 10 after the film prints and card cover 30 have been used and removed therefrom basically, as shown in FIG. 3.

A portion of the rearward end 18 of the film power pack 10 can be forcibly removed, the forward end 16 portion being removed as shown in FIG. 3. After the removal of a portion of the rearward end 18, one end portion of the battery element portion 40 is partially exposed, as indicated in FIG. 3. The battery element portion 40 is removable by grasping the exposed end portion of the battery element portion 40 and pulling the battery element portion 40 in a direction 42 (FIG. 3).

Shown in FIGS. 4, 5, 6 and 7 is the removed battery element portion 40. The battery element portion 40 has an upper surface 44, a lower surface 46, a forward end 48, a rearward end 50, a first side 52 and a second side 54. The battery element portion 40 also has a length 56 (FIG. 4) extending generally between the forward and rearward ends 48 and 50, a width 58 (FIG. 5) extending generally between the first and second sides 52 and 54, and a height 60 (FIG. 6) extending generally between the upper and lower surfaces 44 and 46. In one aspect, the present invention contemplates utilizing the removed battery element portion 40, as shown in FIGS. 4, 5, 6 and 7.

Since the present invention contemplates using either the film power pack 10, as shown in FIG. 3, or only the removed battery element portion 40, as shown in FIGS. 4, 5, 6 and 7, the term "film power pack" as used in the appended claims means either the film power pack, as shown in FIG. 3, or the removed battery element portion, as shown in FIGS. 4, 5, 6 and 7.

EMBODIMENT OF FIGS. 8, 9 AND 10

Figure 8:
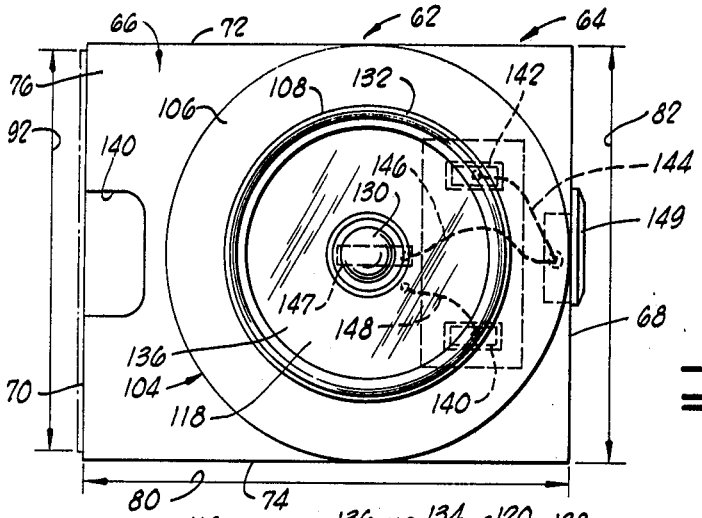
FIG. 8 is a top elevational view of a light emitting device adapted to utilize a film power pack as the source of electrical energy.
Figure 9:
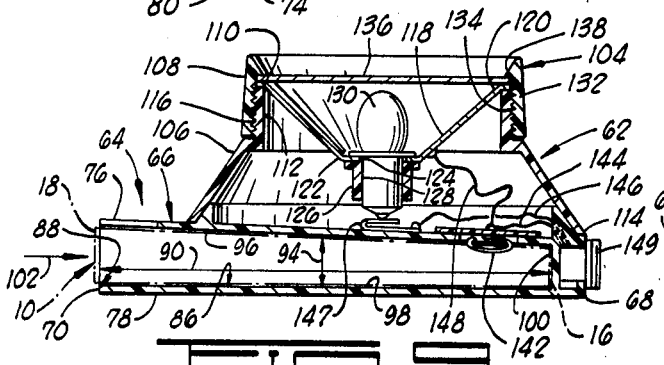
FIG. 9 is a cross-sectional view of the light emitting device of FIG. 8.
Figure 10:
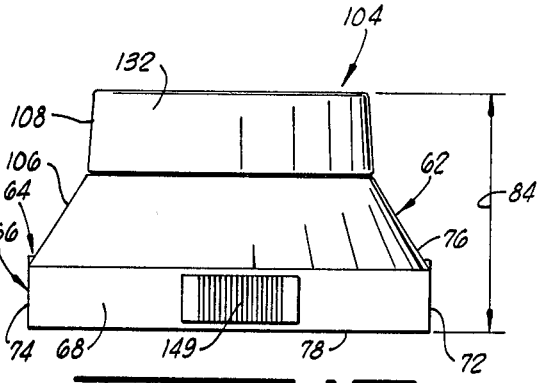
FIG. 10 is an end elevational view of the light emitting device of FIGS. 8 and 9.

Shown in FIGS. 8, 9 and 10 is a battery assembly 62 which is constructed in accordance with the present invention and adapted to utilize the film power pack 10, shown in FIG. 3, as the source of electrical energy. The battery assembly 62, shown in FIGS. 8, 9 and 10, more particularly, is constructed to form a light emitting device 64 of the type generally referred to in the art as a "flashlight".

The light emitting device 64 includes a case 66 having a forward end 68, a rearward end 70, a first side 72, a second side 74, an upper surface 76 and a lower surface 78. The case 66 has a length 80 (FIG. 8) extending generally between the forward and rearward ends 68 and 70, a width 82 (FIG. 8) extending generally between the first and second sides 72 and 74 and a height 84 (FIG. 10) extending generally between the upper and lower surfaces 76 and 78.

A holding opening 86 (FIG. 9) is formed in a portion of the case 66 and extends a distance through the case 66 intersecting the rearward end 70 of the case 66 to form a receiving opening 88. As shown in FIG. 9, the holding opening 86 has a length 90, a width 92 (FIG. 8) and a height 94 (FIG. 9), the receiving opening 88 having a width which is substantially the same as the width 92 of the holding opening 86. The holding opening 86 is tapered downwardly generally from the rearward end 70 toward the forward end 68 of the case 66, so the height of the holding opening 86 generally at the rearward end 70 of the case 66 is greater than the height of the holding opening 86 generally near the forward end 68 of the case 66, the height 94 being approximately the average height of the holding opening 86. The holding opening 86 forms an upper surface 96, a lower surface 98 and an end face 100 in the case 66.

The height of the receiving opening 88 is about the same as the height of the film power pack 10 (FIG. 3) generally at the rearward end 18 of the film power pack 10 (FIG. 3). The width 94 of the holding opening 86 is about the same as the width 26 of the film power pack 10 (FIG. 3) and the length 90 of the holding opening 86 is about the same as the length 24 of the film power pack 10 (FIG. 3). The taper of the holding opening 86 is about the same as the taper of the film power pack 10 (FIG. 3).

The receiving opening 88 is sized and adapted to receive the film power pack 10 (FIG. 3) and the holding opening 86 is sized and adapted to receive and retainingly accommodate a substantial portion of the film power pack 10 (FIG. 3). More particularly, the forward end 16 portion of the film power pack 10 (FIG. 3) is inserted into the receiving opening 88 with the upper surface 12 of the film power pack 10 (FIG. 3) disposed near and generally adjacent the upper surface 96 formed by the case 66 by the holding opening 86 and the lower surface 14 of the film power pack 10 (FIG. 3) dispersed near and generally adjacent the lower surface 98 formed in the case 66 by the holding opening 86. Then, the film power pack 10 (FIG. 3) is moved in the direction 102 into the holding opening 86 to a position wherein the forward end 16 of the film power pack 10 (FIG. 3) abuts the end face 100 formed in the case 66 by the holding opening 86, thereby disposing the film power pack 10 (FIG. 3) in the holding opening 86.

The case 66 includes a retaining assembly 104 having a a base 106 and a transparent cover 108, the transparent cover 108 being removably connected to the base 106. The retaining assembly 104 can be constructed as a separate component and connected to the upper surface 76 of the case 66 generally near the forward end 68, or between the forward and rearward ends 68 and 70, or the base 106 can be constructed integrally with the case 66 if desired in some applications.

The base 106 has a generally circularly shaped cross-section and extends a distance upwardly from the upper surface 76 of the case 66, terminating with an upper end 110. An opening 112 extends through the base 106 intersecting the upper end 110, the opening 112 also intersecting a lower end 114 of the base 106, as shown in FIG. 9. The base 106 is tapered inwardly from the lower end 114 toward the upper end 110, and a portion of the base 106, generally near the upper end 110, extends vertically upwardly forming an annular exterior wall 116. The annular wall 116 is threaded.

A reflector 118 is disposed within the opening 112 of the base 106, the reflector 118 having an upper end 120 and a lower end 122. The reflector 118 has a generally conical shape and is tapered inwardly generally from the upper end 120 toward the lower end 122. The reflector 118 is constructed of a material which is capable of reflecting light. The upper end 120 of the reflector 118 is flanged outwardly and is disposed on and supported by the upper end 110 of the base 106.

An opening 124 is formed through the lower end 122 of the reflector 118 and one end of a sleeve 126 is connected to the reflector 118 generally about the opening 124. The sleeve 126 has an opening 128 extending therethrough and intersecting the opposite ends thereof, the opening 128 being aligned with the opening 124. The openings 124 and 128 are sized and adapted to receive and retainingly hold a light emitting means or, more particularly, a light bulb 130, one end of the light bulb 130 extending downwardly beyond the end of the sleeve, as shown in FIG. 9. The light bulb 130 is constructed to emit light when connected to a source of electrical energy in a manner well-known in the art.

The transparent cover 108 includes a generally circularly shaped support 132 having an opening 134 extending axially through a central portion and intersecting the opposite ends thereof. A circularly shaped transparent plate 136 is disposed in the support 132 and the transparent plate 136 is constructed of a material which allows light to be emitted therethrough. A portion of the internal surface formed by the opening 134 through the support 132 is threaded and sized to threadingly engage the threaded portions formed on the base 106 to threadingly connect the base 106 to the transparent cover 108.

In a connected position, a portion of the reflector 118 is disposed on the upper end 110 of the base 106 and a portion of the transparent plate 136 also is disposed on the upper end 110 of the base 106, the transparent plate 136 more particularly being disposed on the reflector 118, as shown in FIG. 9. The support 132 then is threaded onto the base 106 and an annular lip portion 138 formed on the base 106 engages a portion of the transparent plate 136 to secure the transparent plate 136 and the reflector 118 in an assembled position. The transparent cover 108 thus substantially covers the light bulb 130 when connected to the base 106 and the cover 108 is removably connectable to the base 106 to provide access to the light bulb 130 for replacing the light bulb 130 in a relatively quick and convenient manner.

As shown in FIGS. 9 and 10, a pair of spring clip-like contacts 140 and 142 are connected to the case 66 and a portion of each of the contacts 140 and 142 is disposed in the holding opening 86. The film power pack 10 (FIG. 3) is inserted in the holding opening 86 and positioned such that the film power pack terminals 36 and 38 generally face the upper surface 96 formed in the case 66 by the holding opening 86 and are disposed generally near the end face 100 or the forward end 68 of the case 66. A portion of each of the contacts 140 and 142 is positioned in the holding opening 86 to contactingly engage one of the film power pack terminals 36 and 38 when the film power pack 10 (FIG. 3) is disposed in the holding opening 86 in a position wherein the forward end 16 of the film power pack 10 (FIG. 3) engages or abuts the end face 100 formed in the case 66 by the holding opening 86.

The contact 142 is connected to the light bulb 130 by conductors 144 and 146 (FIGS. 8 and 9), the conductor 144 more particularly being connected to a switch 149 and the conductor 146 more particularly being connected to the switch 148 and the light bulb 130. The switch 149 thus is interposed in the conductors 144 and 146 between the light bulb 130 and the contact 142. The conductor 146 more particularly is connected to a spring clip 147 which provides the connection to the light bulb 130. The contact 140 is connected to ground or, more particularly, to the reflector 118 by a conductor 148.

The switch 149 is moveably mounted in the case 66, and the switch 149 is moveable to an "off" condition for interrupting electrical continuity between the contact 142 and the light bulb 130 and is moveable to an "on" condition for establishing electrical continuity between the contact 142 and the light bulb 130. Thus, in the "on" condition of the switch 149, electrical continuity is established between the film power pack 10 (FIG. 3) and the light bulb 130 and the light bulb 130 emits light, the film power pack 10 (FIG. 3) providing the source of electrical energy for causing the light bulb 130 to emit light. In the "off" condition of the switch 149, electrical continuity is interrupted between the film power pack 10 (FIG. 3) and the light bulb 130 and, in this condition, the light bulb 130 does not emit light.

An opening 140 (FIG. 8) is formed through the upper surface 76 of the case 66 and the opening 140 intersects the rearward end 70 and a portion of the holding opening 86. The opening 140 provides access to a film power pack 10 (FIG. 3) disposed in the holding opening 86 to facilitate the removal of the film power pack 10 from the holding opening 86.

Figure 11:
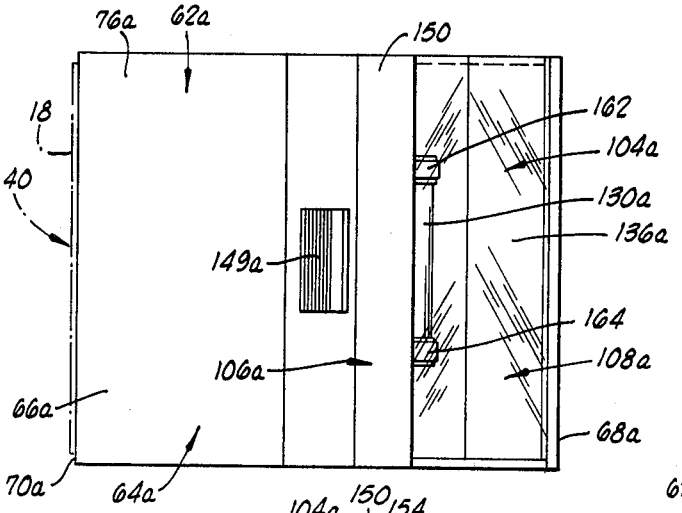
FIG. 11 is a top elevational view, similar to FIG. 8, but showing a modified light emitting device.
Figure 12:
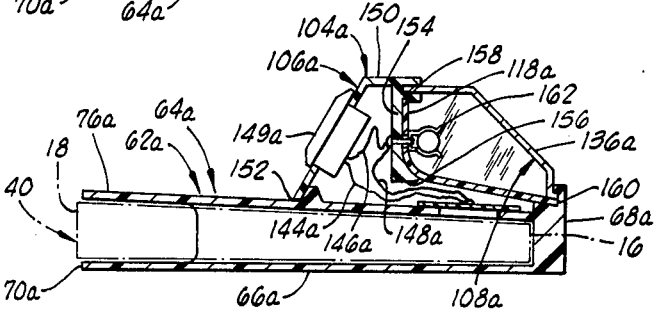
FIG. 12 is a cross-sectional view of the modified light emitting device of FIG. 11.
Figure 13:
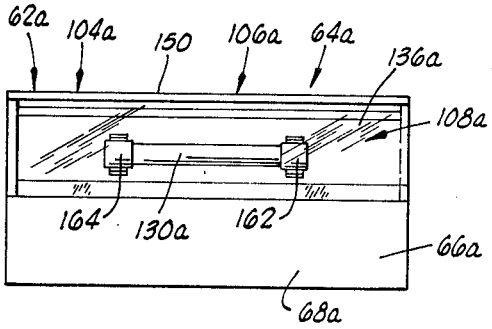
FIG. 13 is an end elevational view of the modified light emitting device of FIGS. 11 and 12.

EMBODIMENT OF FIGS. 11, 12 and 13

Shown in FIGS. 11, 12 and 13 is a modified battery assembly **62*a* which is adapted to form a modified light emitting device 64*a* or, in other words, a flashlight. The modified light emitting device 64*a* is constructed exactly like the light emitting device 64, shown in FIGS. 8, 9 and 10 and described in detail before, except the light emitting device 64*a* includes a modified retaining assembly 104*a*. Thus, all of the reference numerals relating to like structures shown in FIGS. 8, 9 and 10 have not been repeated in the drawings of FIGS. 11, 12 and 13, and only those reference numerals used to describe the different constructions have been repeated in FIGS. 11, 12 and 13**.

The modified retaining assembly 104*a* includes a modified base 106*a* and a modified transparent cover 108*a*. The retaining assembly 104*a* can be constructed as a separate component and connected to the upper surface 76*a* of the case 66*a* generally near the forward end 68*a*, or the retaining assembly 104*a* can be constructed integrally with the case 66*a*, except for the reflector and the transparent plate to be described below.

The base 106*a* has an upper end 150 and a lower end 152. The base 106*a* extends a distance upwardly from the upper surface 76*a* of the case 66*a* and the upper end 150 portion thereof extends toward the forward end 68*a* generally in a horizontal plane. As shown in FIG. 12, a flange 154 has one end connected to the upper end 150 portion of the base 106*a* and the flange 154 extends a distance downwardly therefrom generally toward the upper surface 76*a* of the case 66*a* terminating with a lower end 156 which is spaced a distance from the upper surface 76*a*.

A switch 149*a* is mounted through an opening in the base 106*a* with a portion of the switch 149*a* being disposed in the space between the base 106*a* and the flange 154 portion, as shown in FIG. 12. The switch 149*a* operates exactly like the switch 149 described in detail before.

A reflector 118*a* is connected to the base 106*a*, as shown in FIG. 12. The reflector 118*a* has an upper end 158 which is removably connected to the upper end 150 portion of the base 106*a* and the reflector 118*a* extends a distance generally along the flange 154 and then angles outwardly toward the forward end 68*a* of the case 66*a* terminating with a lower end 160. The lower end 160 is removably connected to the forward end 68*a* of the case 66*a*.

A pair of spring clips 162 and 164 have portions which extend through openings in the reflector 118*a* and the flange 154. A portion of each clip 162 and 164 disposed near the reflector 118*a* are adapted to removably hold a light emitting means or a light bulb 130*a*. The light bulb 130*a* operates exactly like the light bulb 130, the light bulb 130*a* being of a slightly different construction, but of a type generally familiar to those skilled in the art.

A transparent plate 136*a* is removably connected to the base 106*a*. One end of the transparent plate 136*a* is removably inserted into a slot formed in the base 106*a* generally near the connection of the flange 154 and the opposite end of the transparent plate 136*a* is removably connected to the forward end 68*a* portion of the case 66*a*. As shown in FIG. 12, the transparent plate 136*a* cooperates to secure the reflector 118*a* in an assembled position when the transparent plate 136*a* is connected to the forward end 68*a* portion of the case 66*a*. The transparent plate 136*a* is removable to provide access to light bulb 130*a* to facilitate the insertion or replacement of the light bulb 130*a*.

The light emitting device 64*a* includes a pair of contacts (not shown) which are disposed and operate exactly like the contacts 140 and 142, described before, and the contacts (not shown) are connected to ground and to the light bulb 130*a* through the switch 149*a* in a manner like that described before with respect to the light bulb 130, the switch 149, the contacts 140 and 142 and the conductors 144, 146 and 148, except one of the conductors is connected directly to the clip 162 and the other conductor is connected directly to the clip 164. The conductors are shown in FIG. 12 and designated therein by the reference numerals 144*a*, 146*a* and 148*a*.

EMBODIMENT OF FIGS. 14, 15 AND 16

Figure 14:
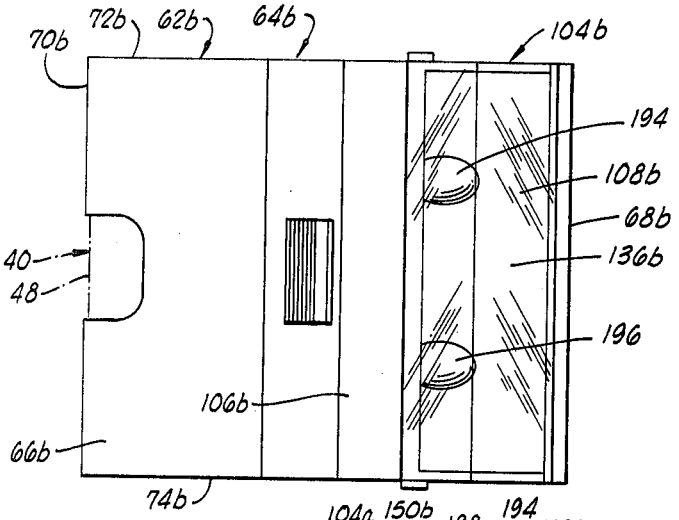
FIG. 14 is a top elevational view of another modified light emitting device.
Figure 15:
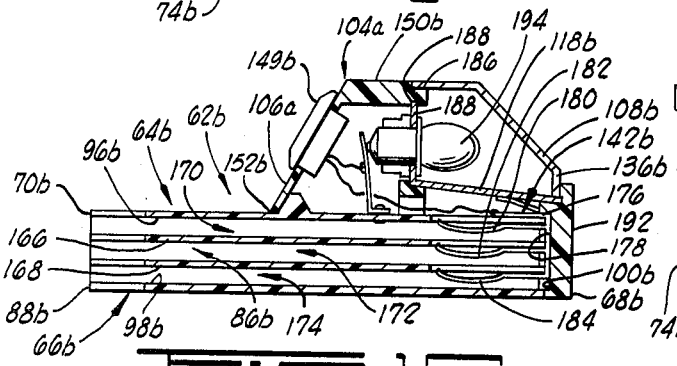
FIG. 15 is a cross-sectional view of the modified light emitting device of FIG. 14.
Figure 16:
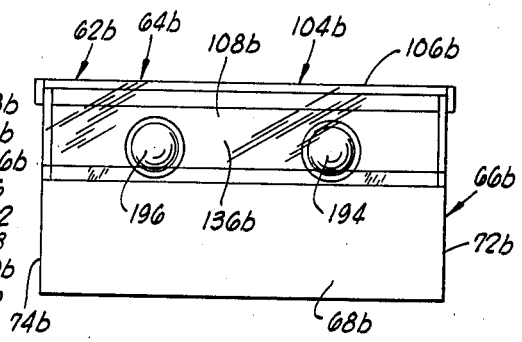
FIG. 16 is an end elevational view of the modified light emitting device of FIGS. 14 and 15.

Shown in FIGS. 14, 15 and 16 is a modified battery assembly 62*b* which is adapted to form a modified light emitting device 64*b*. The modified light emitting device 64*b* is constructed exactly like the light emitting device 64, shown in FIGS. 8, 9, and 10 and described before, except the light emitting device 64*b* includes a modified case 66*b* having a modified holding opening 86*b* (FIG. 15) extending through a portion thereof and intersecting the rearward end 70*b* forming a modified receiving opening 88*b*, and a modified retaining assembly 104*b*. Thus, all of the reference numerals relating to like structures shown in FIGS. 8, 9 and 10 or FIGS. 11, 12 and 13 have not been repeated in the drawings of FIGS. 14, 15 and 16, and only those reference numerals used to describe the different constructions have been repeated in FIGS. 14, 15 and 16.

As shown in FIG. 15, two dividers 166 and 168 are disposed in the holding opening 86*b*. Each divider 166 and 168 extends generally between the forward and rearward ends 68*b* and 70*b* of the case 66*b* and generally between the first and second sides 72*b* and 74*b* of the case 66*b*. The divider 166 is spaced a distance from the upper surface 96*b* and a distance from the other divider 168. The divider 168 also is spaced a distance from the lower surface 98*b*. The dividers 166 and 168 are spaced apart and positioned in the holding opening 86*b* and cooperate with the upper and lower surfaces 96*b* and 98*b* of the case 66*b* to form three holding spaces, 170, 172 and 174. Each holding space 170, 172 and 174 is sized and adapted to receive and retainingly accommodate one battery element portion 40 (FIGS. 4–7).

As shown in FIG. 15, the light emitting device 64*b* also includes a pair of modified contacts (only the contact 142*b* being shown in FIG. 15). Each of the contacts includes a bar 176 having a portion 178 which extends generally along the end face 100*b* formed in the case 66*b* and three protruding contact portions 180, 182 and 184, only the contact portions 180, 182 and 184 of the contact 140*b* being shown in FIG. 15. Each protruding contact portion 180, 182 and 184 of the contacts is connected to the bar portion 178 and is disposed in one of the holding spaces 170, 172 and 174, and each contact portion 180, 182 and 184 of the contact 140*b* is positioned and shaped to contact the film power pack terminal 36 of one of the battery element portions 40 (FIGS. 4–7) disposed in one of the holding spaces 170, 172 or 174. Each contact portion 180, 182 and 184 of the other contact (not shown) is connected to the bar portion 178 of that contact and is disposed in one of the holding spaces 170, 172 and 174, and each contact portion 180, 182 and 184 of the other contact (not shown) is positioned and shaped to contact the film power pack terminal 38 of one of the battery element portions 40 (FIGS. 4–7) disposed in one of the holding spaces 170, 172 or 174. The contacts connect the film power pack terminals 36 and 38 in such a manner that the battery element portions 40 (FIGS. 4–7) disposed in the holding spaces 170, 172 and 174 are connected in electrical parallel.

The modified retaining assembly 104*b* includes a modified base 106*b* and a modified transparent cover 108*b*. The retaining assembly 104*b* can be constructed as a separate component and connected to the upper surface 76*b* of the case 66*b* generally near the forward end 68*b*, or the retaining assembly 104*b* can be constructed integrally with the case 66b, except for the reflector and the transparent plate to be described below.

The base 106b is constructed exactly like the base 106a (shown in FIGS. 11, 12 and 13), except the base 106b does not include flange 154 portion. A recess 186 is formed in the upper surface of the upper end 150b and a slot 188 is formed in the lower surface of the lower end 152b. A switch 149b is disposed through the base 106b in a manner exactly like that shown and described before with respect to the switch 149a and base 106a, shown in FIGS. 11, 12 and 13.

Figure 18:
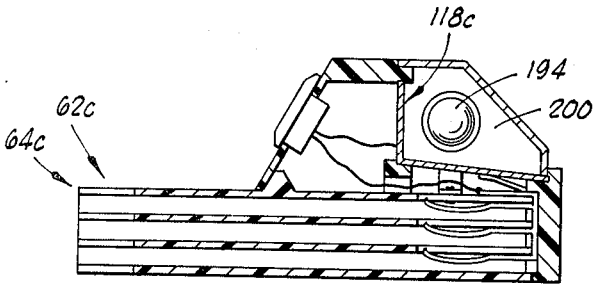
FIG. 18 is a cross-sectional view of the modified light emitting device of FIG. 17.

A reflector 118b is connected to the base 106b, as shown in FIG. 18. The reflector 118b has an upper end 188 which is removably disposed in the slot 188 formed in the upper end 150b portion of the base 106b and the reflector 118b extends a distance generally downwardly toward the upper surface 76b of the case 66b and then angles outwardly toward the forward end 68b of the case 66b terminating with a lower end 192. The lower end 192 is removably connected to the forward end 68b of the case 66b.

Portions of a pair of spaced apart light bulbs 194 and 196 are disposed through and retained in the reflector 118b. The light bulbs 194 and 196 each are removably retained in the reflector 118b. Each light bulb 194 and 196 is of the type and operates like the light bulb 130 (FIGS. 8 and 9).

A transparent plate 136b is removably connected to the base 106b. One end of the transparent plate 136b is removably inserted into the recess 186 formed in the base 106b and the opposite end of the transparent plate 136b is removably connected to the forward end 68b portion of the case 66b. As shown in FIG. 16, the transparent plate 136b cooperates to secure the reflector 118b in an assembled position when the transparent plate 136b is connected to the forward end 68b portion of the case 66b. The transparent plate 136b is removable to provide access to light bulbs 194 and 196 to facilitate the insertion or replacement of the light bulbs 194 and 196.

The contact 142b (shown in FIG. 15) is connected to each light bulb 194 and 196 with the switch 149b being interposed between each light bulb 194 and 196 and the contact 142b, only the conductors connecting the light bulb 194 being shown in FIG. 15. The contact 140b (not shown) is connected to ground.

When a battery element portion 40 (FIGS. 4–7) is disposed in one of the holding spaces 170, 172 or 174 in the holding opening 86b, the film power pack terminals 36 and 38 of that battery element portion 40 (FIGS. 4–7) generally face the upper surface 96b formed in the case 66b by the holding opening 86b. In this position, one of the contact portions 180, 182 or 184 of the contacts 140b and 142b (contact 142b not being shown in FIGS. 14, 15 and 16) each contactingly engage one of the film power pack terminals 36 and 38 in a manner and for reasons described before with respect to the light emitting device 64.

The light emitting device 64b operates exactly like the light emitting device 64, except the light emitting device 64b is adapted to utilize three battery element portions 40 (film power pack), as shown in FIGS. 4–7, to provide the electrical power supply.

EMBODIMENT OF FIGS. 17, 18 AND 19

Figure 17:
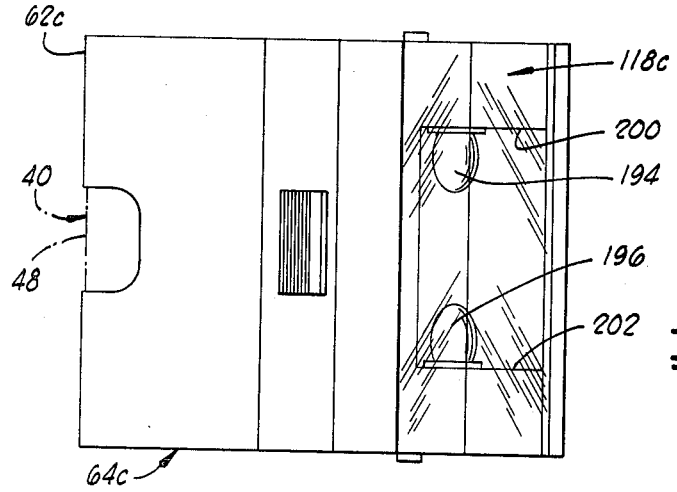
FIG. 17 is a top elevational view of yet another modified light emitting device.
Figure 19:
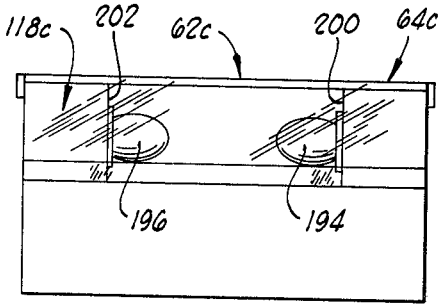
FIG. 19 is an end elevational view of the modified light emitting device of FIGS. 17 and 18.

Shown in FIGS. 17, 18 and 19 is another modified battery assembly 62c which is adapted to produce a modified light emitting device 64c. The light emitting device 64c is constructed exactly like the light emitting device 64b, shown in FIGS. 14, 15 and 16 and described in detail before, except the battery assembly 62c includes a modified reflector 118b. All of the reference numerals relating to like structures shown in FIGS. 14, 15 and 16 or the earlier described Figures have not been repeated in FIGS. 17, 18 and 19, and only those reference numerals used to describe the different constructions have been repeated in FIGS. 17, 18 and 19.

The reflector 118b includes a pair of spaced apart side shields 200 and 202. The light bulb 194 is disposed through and removably retained in the side shield 200 and the light bulb 196 is disposed through and removably retained in the side shield 202.

The light emitting device 64c operates exactly like the light emitting device 64b, except the light emitting device 64c provides a slightly different mounting of the light bulbs 194 and 196.

EMBODIMENT OF FIGS. 20 AND 21

Figure 20:
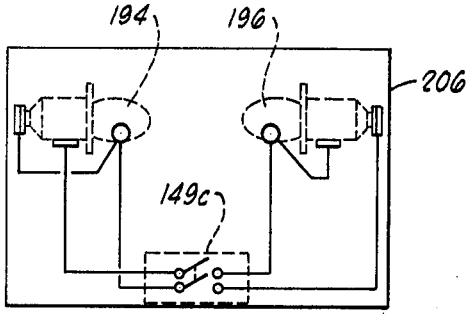
FIG. 20 is a schematic view of a portion of the electrical circuit utilized in the light emitting device of the present invention.
Figure 21:
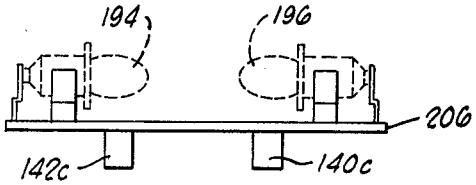
FIG. 21 is a view of a portion of the light emitting device of the present invention, showing the contacts for electrically contacting the film power pack terminals.

Shown in FIGS. 20 and 21 is a schematic view showing a portion of the electrical circuit which can be utilized with the light emitting devices of the present invention, the circuit shown in FIGS. 20 and 21 being particularly illustrated with respect to the light emitting device 64c, shown in FIGS. 17, 18 and 19.

The light bulbs 194 and 196 are each connected to the switch 149c, the switch 149c being shown in the open position in FIG. 20. The switch 149c terminals also are connected to the contacts 140c and 142c. As shown in FIGS. 20 and 21, the light bulbs 194 and 196, the contacts 140c and 142c and some of the electrical wiring can be mounted on a circuit board 206 which is adapted for mounting to the case 66c. This construction permits the circuit board 206 and the components mounted thereon to be constructed as a separate component and then assembled in the case 66c to complete the light emitting device 64c.

The concept of the circuit board mounting shown in FIGS. 20 and 21 also could be utilized in the construction of the other light emitting devices disclosed herein.

EMBODIMENT OF FIG. 22

Figure 22:
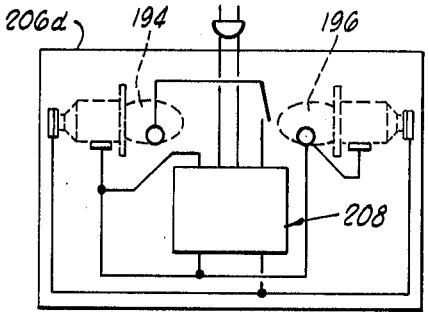
FIG. 22 is a schematic view, similar to FIG. 20, but showing a portion of a modified electrical circuit which may be utilized on the light emitting device of the present invention.

Shown in FIG. 22 is a circuit board 206d which is adapted to be utilized with the modified circuit shown in FIG. 22. The circuit shown in FIG. 22 is exactly like the circuit shown in FIGS. 20 and 21, except the circuit shown in FIG. 22 includes a DC voltage charger 208 which is connectable to a 110 volt AC power supply (not shown) for charging the film power pack. DC voltage chargers of the type shown in FIG. 22 are commercially available and the construction and operation of such DC voltage chargers are well-known in the art.

EMBODIMENT OF FIGS. 23, 24, 25 AND 26

Shown in FIGS. 23, 24, 25 and 26 is another modified battery assembly 62e.

The battery assembly 62e includes a case 250. The case 250 has a forward end 252 (FIG. 23), a rearward end 254 (FIG. 26), a first side 256, a second side 258, an upper surface 260 and a lower surface 262. A holding opening 264 extends a distance through the case 250 and intersects a portion of the rearward end 254 to form a receiving opening 266 (FIG. 26).

Figure 24:
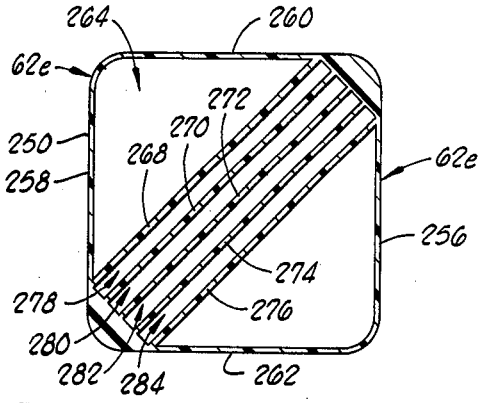
FIG. 24 is a cross-sectional view of the battery assembly shown in FIG. 23, taken substantially along the lines 24—24 of FIG. 23.
Figure 23:
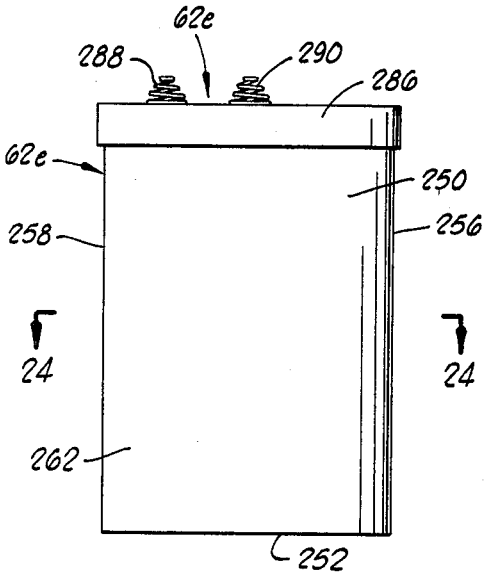
FIG. 23 is a side elevational view of a battery assembly adapted to utilize a film power pack as the source of electrical energy.
Figure 26:
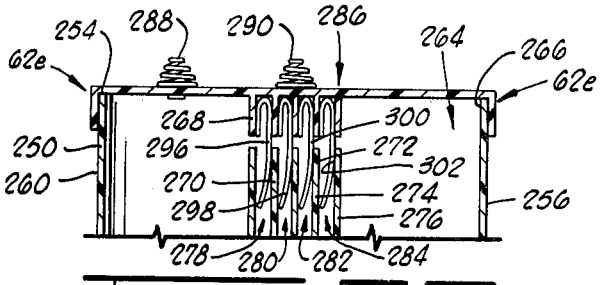
FIG. 26 is a partial cross-sectional view of a portion of the battery assembly of FIG. 23 showing the contacts for electrically contacting the film power pack terminals, taken substantially along the lines 26—26 of FIG. 25.
Figure 27:
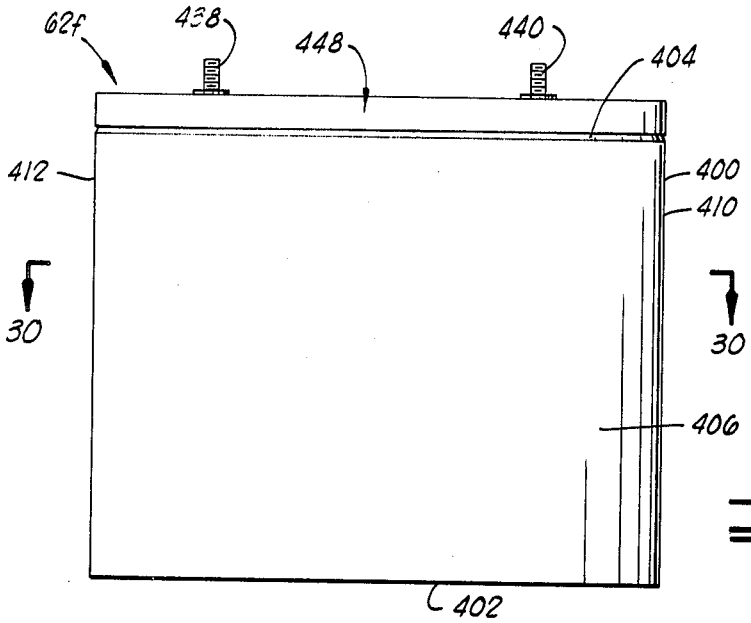
FIG. 27 is a typical side elevational view of another modified battery assembly.

Five dividers 268, 270, 272, 274 and 276 are disposed in the holding opening 264 of the case 250 as shown more clearly in FIGS. 24 and 26. Each of the dividers 268, 270, 272, 274 and 276 extends generally between opposite corners of the case 250 and diagonally across the case 250. The dividers 268, 270, 272, 274 and 276 also each extend generally between the forward and the rearward ends 252 and 254 of the case 250. The dividers 268, 270, 272, 274 and 276 are spaced a distance apart and cooperate to form four holding spaces 278, 280, 282 and 284. Each of the holding spaces 278, 280, 282 and 284 is sized to slidingly receive one battery element portion 40 (FIGS. 4–7) in a manner and for reasons like that described before with respect to the holding spaces 170, 172 and 174 (FIG. 15).

The battery assembly **62*e* has a cap 286 which is removably connected to the rearward end 254. A first spring terminal 288 is connected to the cap 286 and a second spring terminal 290 also is connected to the cap 286**.

Figure 25:
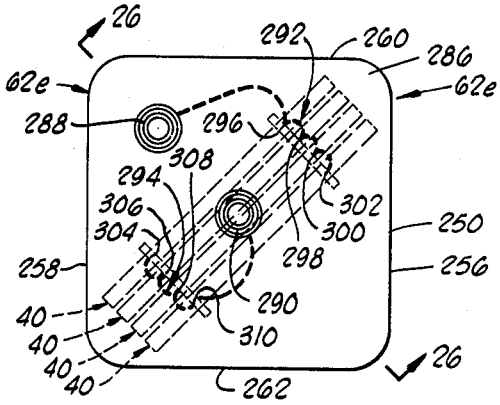
FIG. 25 is a top elevational view of the battery assembly shown in FIGS. 23 and 24.

The battery assembly **62*e* also includes a pair of contacts 292 and 294. The contact 292 is connected to the first spring terminal 288, as indicated in FIG. 25, and includes four protruding contact portions 296, 298, 300 and 302. The contact portion 296 is disposed in the holding space 278 and is positioned to contactingly engage the film power pack terminal 36 of a battery element portion 40 (FIGS. 4–7) when the battery element portion 40 (FIGS. 4–7) is inserted into the holding space 278. The contact portion 298 is disposed in the holding space 280 and is positioned to contactingly engage the film power pack terminal 36 of a battery element portion 40 (FIGS. 4–7) when the battery element portion 40 (FIGS. 4–7) is inserted into the holding space 280. The contact portion 300 is disposed in the holding space 282 and is positioned to contactingly engage the film power pack terminal 36 of a battery element portion 40 (FIGS. 4–7) when the battery element portion 40 (FIGS. 4–7) is inserted into the holding space 282. The contact portion 302 is disposed in the holding space 284 and is positioned to contactingly engage the film power pack terminal 36 of a battery element portion 40 (FIGS. 4–7) when the battery element portion 40 (FIGS. 4–7) is inserted into the holding space 284. The contact 294 is connected to the second spring terminal 290, as indicated in FIG. 25, and includes four protruding contact portions 304, 306, 308 and 310. The contact portion 304 is disposed in the holding space 278 and is positioned to contactingly engage the film power pack terminal 38 of a battery element portion 40 (FIGS. 4–7) when the battery element portion 40 (FIGS. 4–7) is inserted into the holding space 278. The contact portion 306 is disposed in the holding space 280 and is positioned to contactingly engage the film power pack terminal 38 of a battery element portion 40 (FIGS. 4–7) when the battery element portion 40 (FIGS. 4–7) is inserted into the holding space 280. The contact portion 308 is disposed in the holding space 282 and is positioned to contactingly engage the film power pack terminal 38 of a battery element portion 40 (FIGS. 4–7) when the battery element portion 40 (FIGS. 4–7) is inserted into the holding space 282. The contact portion 310 is disposed in the holding space 284 and is positioned to contactingly engage the film power pack terminal 38 of a battery element portion 40 (FIGS. 4–7) when the battery element portion 40 (FIGS. 4–7) is inserted into the holding space 284**.

Thus, the contacts 292 and 294 cooperate to provide the electrical connection between the battery element portions 40 (FIGS. 4–7) disposed in the holding spaces 278, 280, 282 and 284 and the first and second spring terminals 288 and 290 so the electrical energy provided by the battery element portions 40 (FIGS. 4–7) disposed in the holding spaces 278, 280, 282 and 284 is provided at the spring terminals 288 and 290. The contact portions 296, 298, 300, 302, 304, 306, 308 and 310 cooperate to connect the battery element portions 40 (FIGS. 4–7) disposed in the holding spaces 278, 280, 282 and 284 in electrical series to provide about a six volt DC power supply at the spring terminals 288 and 290.

The case 250 of battery assembly **62*e* has a generally square-shaped cross-section and the case 250 and cap 286 are sized and shaped to approximate the size and shape of an available No. 509 NEDA 908 battery such as commercially available from Union Carbide Corporation of New York, N.Y., under the trademark "Eveready", for example. The battery assembly 62*e* provides a replacement for batteries of the type designated as NEDA 908 (referred to above), yet the battery assembly 62*e* is constructed to utilize four battery element portions 40** or film power packs (FIGS. 4–7) as the source of electrical energy.

EMBODIMENT OF FIGS. 27, 28, 29 AND 30

Shown in FIGS. 27, 28, 29 and 30 is another modified battery assembly **62*f***.

The battery assembly **62*f* includes a case 400. The case 400 has a forward end 402, a rearward end 404, a first side 406, a second side 408, an upper surface 410 and a lower surface 412. A holding opening 414 (FIG. 30) extends a distance through the case 400 and intersects a portion of the rearward end 404** to form a receiving opening.

Figure 30:
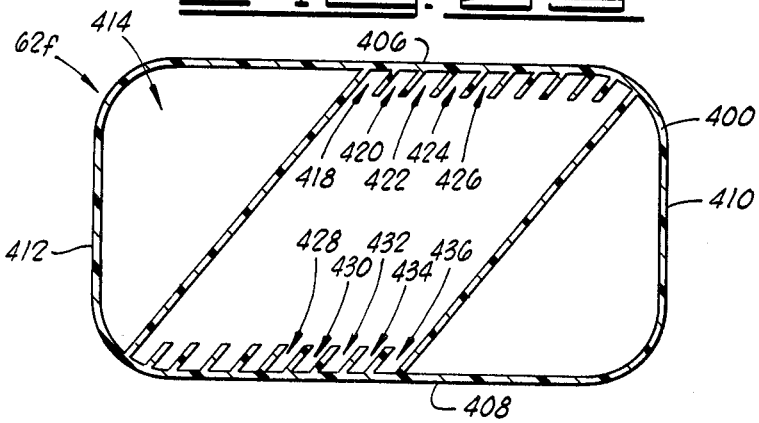
FIG. 30 is a cross-sectional view of the battery assembly of FIGS. 27, 28 and 29.

Ten slots are formed in the upper surface 406 and ten slots are formed in the lower surface 408. Each of the slots in the upper surface 406 is aligned with one of the slots in the lower surface 408, and the aligned slots cooperate to form ten holding spaces 418, 420, 422, 424, 426, 428, 430, 432, 434 and 436. The slots in the upper surface 406 are each offset generally diagonally with respect to the aligned slots in the lower surface 408 so the holding spaces 418–436 each extend generally diagonally across the holding opening 414, as shown in FIG. 30. Each of the holding spaces 418–436 is sized and shaped to slidingly receive one of the battery element portions 40 (FIGS. 4–7).

The battery assembly **62*f* also includes a first and a second terminal 438 and 440. A contact 442 (FIG. 29) is connected to the first terminal 438 and the contact 442 includes contact portions (not shown) which are constructed and function in a manner like that described before with respect to the contact portions 296–302, with each of the contact portions being disposed in one of the holding spaces 418–436 and positioned to contactingly engage the film power pack terminal 36 of one of the battery element portions (FIGS. 4–7). A contact 444 (FIG. 29) is connected to the second terminal 440 and the contact 444 includes contact portions (not shown), which are constructed and function in a manner like that described before with respect to the contact portions 304–310, with each of the contact portions being disposed in one of the holding spaces 418–436 and positioned to contactingly engage the film power pack terminal 38 of one of the battery element portions (FIGS. 4–7). The contacts 442 and 444 cooperate to connect the battery element portions 40 (FIGS. 4–7) in electrical series to provide about a twelve volt DC power supply at the terminals 438 and 440**.

Figure 28:
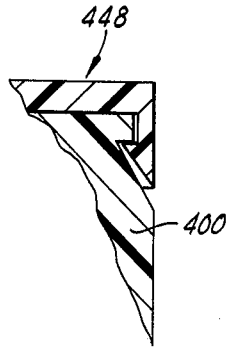
FIG. 28 is a cross-sectional view showing the connection of the top to the base of the battery assembly shown in FIG. 27.
Figure 29:
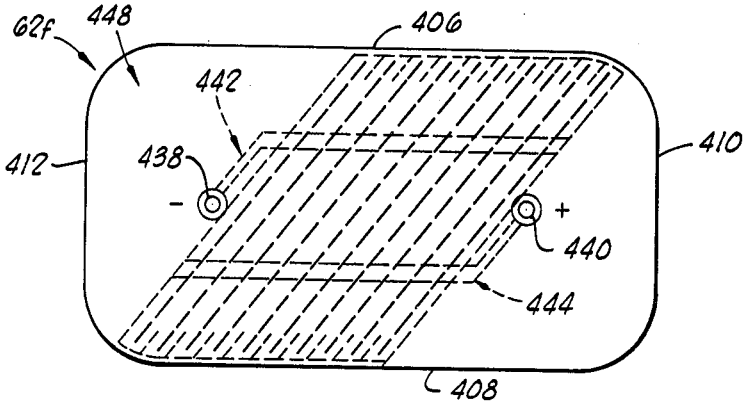
FIG. 29 is a top elevational view of the battery assembly of FIGS. 27 and 28.

The battery assembly 62f has a cap 448 which is removably connected to the rearward end 404, the clip type removable connection being shown in FIG. 28. The terminals 438 and 440 each extend through the cap 448.

The case 400 of battery assembly 62f has a generally square-shaped cross-section and the case 400 and cap 446 are shaped to approximate the size and shape of an available No. 732 NEDA 926 battery such as commercially available from Union Carbide Corporation of New York, N.Y., under the trademark "Eveready", for example. The battery assembly 62f provides a replacement for batteries of the type designated as NEDA 926, (referred to above), yet the battery assembly 62f is constructed to utilize ten battery element portions 40 or film power packs (FIGS. 4–7) as the source of electrical energy.

EMBODIMENT OF FIGS. 31 AND 32

Figure 31:
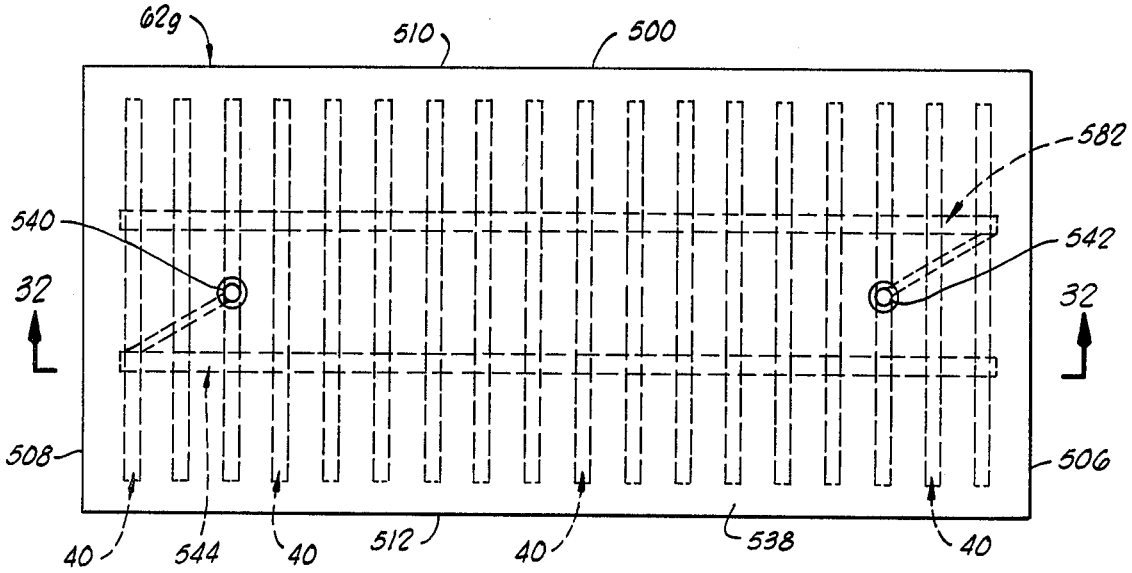
FIG. 31 is a top elevational view showing yet another modified battery assembly.
Figure 32:
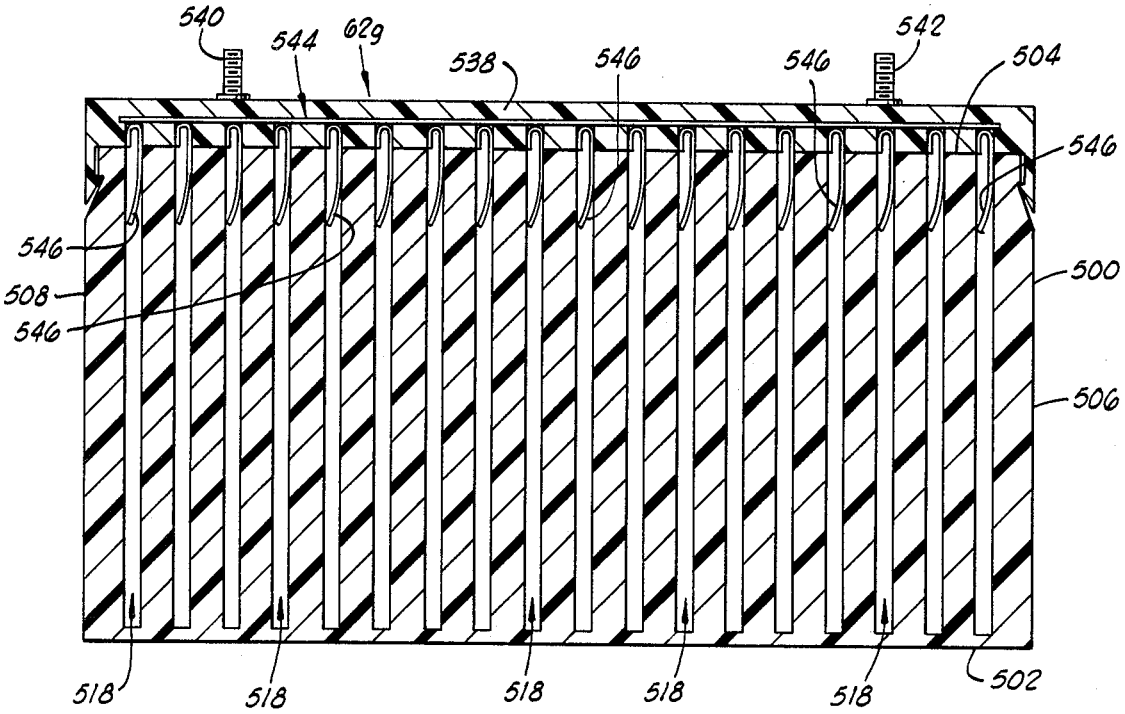
FIG. 32 is a side cross-sectional view of the battery assembly of FIG. 31, taken substantially along the lines 32—32 of FIG. 31.

Shown in FIGS. 31 and 32 is another modified battery assembly 62g.

The battery assembly 62g includes a case 500. The case 500 has a forward end 502, a rearward end 504, a first side 506, a second side 508, an upper surface 510 and a lower surface 512.

A holding opening extends a distance through the case 500 and intersects a portion of the rearward end 504 to form a receiving opening. Eighteen slots are formed in the rearward end 504 and each slot extends a distance through the case 500 generally toward the forward end 502. Each of the slots in the case 500 forms a holding space 518 (only some of the holding spaces 518 being designated by a reference numeral 518 in FIG. 32). Each of the holding spaces 518 is sized and shaped to slidingly receive one of the battery element portions 40 (FIGS. 4–7). Thus, the holding opening, more particularly, comprises the slots in the case 500 and the receiving opening comprises the intersection of the slots with the rearward end 504.

The battery assembly 62g has a cap 538 which is removably connected to the rearward end 504. A first terminal 540 is connected to the cap 538 and a second terminal 542 also is connected to the cap 538.

The battery assembly 62g also includes a contact 544 connected to the first terminal 540 and the contact 544 includes eighteen contact portions 546 (only some of the contact portions 546 being designated by a reference numeral in FIG. 32) which are constructed and function in a manner like that described before with respect to the contact portions 296–302 with each of the contact portions 546 being disposed in one of the holding spaces 518 and positioned to contactingly engage the film power pack terminal 36 of one of the battery element portions (FIGS. 4–7). A contact 582 is connected to the second terminal 542 and the contact 542 includes eighteen contact portions (not shown), which are constructed and function in a manner like that described before with respect to the contact portions 304–310, with each of the contact portions being disposed in one of the holding spaced 518 and positioned to contactingly engage the film power pack terminal 38 of one of the battery element portions (FIGS. 4–7). The contacts 540 and 542 cooperate to connect the battery element portions 40 (FIGS. 4–7) in electrical series to provide about a twelve volt DC power supply at the terminals 540 and 542.

The case 500 of battery assembly 62g has a generally rectangular-shaped cross-section and the case 500 and cap 538 are sized and shaped to approximate the size and shape of an available No. 732 NEDA 926 battery such as commercially available from Union Carbide Corporation of New York, N.Y., under the trademark "Eveready", for example. The battery assembly 62g provides a replacement for batteries of the type designated as NEDA 926 (referred to above), yet the battery assembly 62g is constructed to utilize eighteen battery element portions 40 or film power packs (FIGS. 4–7) as the source of electrical energy.

Changes may be made in the construction and the operation of the various elements and assemblies and in the various steps of the method described herein without departing from the spirit and the scope of the invention as defined in the claims.

What is claimed is:

1. A battery assembly for replacing one of a NEDA 908 like battery and a NEDA 26 like battery adapted for using a film power pack as a source of electrical energy, the film power pack having a length, a width, and a height, and at least two film power pack terminals, the battery assembly comprising:

a case having a substantially square cross-section in a horizontal plane and a holding opening extending a distance therethrough and intersecting a portion of the case;

a plurality of dividers disposed in the holding opening and connected to the case, each divider being spaced a distance from at least one adjacent divider to form a holding space between each pair of adjacent dividers and each of the holding spaces being sized and adapted for receiving and retainingly accommodating a substantial portion of one film power pack;

contact means connected to the case and having a portion disposed in the holding opening, the portion of the contact means disposed in the holding opening being contactable with the film power pack terminals when the film power packs are disposed in the holding spaces, the contact means contacting the film power pack terminals of each film power pack to connect at least some of the film power packs in electrical series, the source of electrical energy provided by the film power pack being provided at the contact means; and at least two terminals, each terminal connected to the case and to a portion of the contact means, the source of electrical energy provided by the film power pack being provided at the terminals.

2. The battery assembly of claim 1 defined further as being adapted for admitting light via a light emitting means when the light emitting means is connected to a source of electrical energy, and wherein the battery assembly is defined further to include:

means for receiving the light emitting means; and a switch connected to the contact means and connectable to the light emitting means for establishing electrical continuity between the film power pack terminals and the light emitting means in an "on" condition thereby causing the light emitting means to emit light and for interrupting electrical continuity between the film power pack terminals and the light emitting means in an "off" condition, the film power pack providing the source of electrical energy to the light emitting means for causing the light emitting means to emit light in the "on" condition.

3. The battery assembly of claim 1 wherein the means for receiving the light emitting means is defined further to include a retaining assembly connected to the case having a portion adapted for receiving the light emitting means.

4. The battery assembly of claim 3 wherein the retaining assembly is defined further to include:

a base connected to the case; and a transparent cover removably connectable to the base, the cover substantially covering the light emitting means when connected to the base and the cover being removable from the base to provide access to the light emitting means for replacing the light emitting means.

* * * * *